US008123557B2

(12) United States Patent
Montena et al.

(10) Patent No.: US 8,123,557 B2
(45) Date of Patent: Feb. 28, 2012

(54) COMPRESSION CONNECTOR FOR COAXIAL CABLE WITH STAGGERED SEIZURE OF OUTER AND CENTER CONDUCTOR

(75) Inventors: Noah Montena, Syracuse, NY (US); David Jackson, Manlius, NY (US); Daniel Robb, East Syracuse, NY (US); Shawn Chawgo, Cicero, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 127 days.

(21) Appl. No.: 12/421,855

(22) Filed: Apr. 10, 2009

(65) Prior Publication Data

US 2009/0197465 A1 Aug. 6, 2009

Related U.S. Application Data

(63) Continuation-in-part of application No. 11/743,633, filed on May 2, 2007, now Pat. No. 7,993,159.

(51) Int. Cl.
*H01R 9/05* (2006.01)

(52) U.S. Cl. ..... 439/584

(58) Field of Classification Search ..... 439/583, 439/584, 578

See application file for complete search history.

(56) References Cited

U.S. PATENT DOCUMENTS

| | | | |
|---|---|---|---|
| 3,764,959 | A | 10/1973 | Toma et al. |
| 3,910,673 | A | 10/1975 | Stokes |
| 4,531,805 | A | 7/1985 | Werth |
| 4,579,415 | A | 4/1986 | Van Brunt et al. |
| 4,676,577 | A | 6/1987 | Szegda |
| 4,808,128 | A | 2/1989 | Werth |
| 4,952,174 | A | 8/1990 | Sucht et al. |
| 5,199,894 | A | 4/1993 | Kalny et al. |
| 5,322,454 | A | 6/1994 | Thommen |
| 5,393,244 | A | 2/1995 | Szegda |
| 5,435,745 | A | 7/1995 | Booth |
| 5,620,339 | A | 4/1997 | Gray et al. |
| 5,720,630 | A | 2/1998 | Richmond et al. |
| 5,766,037 | A | 6/1998 | Nelson |
| 5,863,220 | A | 1/1999 | Holliday |
| 5,938,474 | A | 8/1999 | Nelson |
| 6,019,519 | A | 2/2000 | Grinderslev et al. |
| 6,019,636 | A | 2/2000 | Langham |
| 6,032,358 | A | 3/2000 | Wild |
| 6,102,738 | A | 8/2000 | Macek et al. |
| 6,109,964 | A | 8/2000 | Kooiman |
| 6,133,532 | A | 10/2000 | Lundbäck et al. |
| 6,183,298 | B1 | 2/2001 | Henningsen |
| 6,206,579 | B1 | 3/2001 | Selfridge et al. |

(Continued)

OTHER PUBLICATIONS

International Search Report/ Written Opinion for PCT Application No. PCT/US2010/029725; mailed Nov. 16, 2010; 8 pages.

(Continued)

*Primary Examiner* — Briggitte R Hammond
(74) *Attorney, Agent, or Firm* — Schmeiser Olsen & Watts

(57) ABSTRACT

A compression connector for a coaxial cable includes a connector body having opposing first and second ends and a center passageway defined therethrough, an insulator disposed within said center passageway adjacent said first end of said connector, and a compression sleeve movably connected to the second end of said connector body. The outer conductor of a prepared coaxial cable end and the center conductor are each seized in sequence based on axial movement of the compression sleeve upon insertion of a prepared cable end. The compression sleeve is axially movable from the second end to the first end to sequentially enable clamps to engage and seize each of the outer and center conductors.

26 Claims, 12 Drawing Sheets

U.S. PATENT DOCUMENTS

| | | | |
|---|---|---|---|
| 6,264,374 | B1 | 7/2001 | Selfridge et al. |
| 6,267,621 | B1 | 7/2001 | Pitschi et al. |
| 6,309,251 | B1 | 10/2001 | Tang |
| 6,331,123 | B1 | 12/2001 | Rodrigues |
| 6,386,915 | B1 | 5/2002 | Nelson |
| 6,471,545 | B1 | 10/2002 | Hosler, Sr. |
| 6,478,618 | B2 | 11/2002 | Wong |
| 6,494,743 | B1 | 12/2002 | Lamatsch et al. |
| 6,607,398 | B2 | 8/2003 | Henningsen |
| 6,733,336 | B1 | 5/2004 | Montena et al. |
| 6,840,803 | B2 | 1/2005 | Wlos et al. |
| 6,884,113 | B1 | 4/2005 | Montena |
| 6,939,169 | B2 | 9/2005 | Islam et al. |
| 6,955,562 | B1 | 10/2005 | Henningsen |
| 7,008,264 | B2 | 3/2006 | Wild |
| 7,021,965 | B1 | 4/2006 | Montena |
| 7,029,304 | B2 | 4/2006 | Montena |
| 7,029,326 | B2 | 4/2006 | Montena |
| 7,070,447 | B1 | 7/2006 | Montena |
| 7,077,699 | B2 | 7/2006 | Islam et al. |
| 7,086,897 | B2 | 8/2006 | Montena |
| 7,104,839 | B2 | 9/2006 | Henningsen |
| 7,108,547 | B2 | 9/2006 | Kisling et al. |
| 7,112,093 | B1 | 9/2006 | Holland |
| 7,128,603 | B2 | 10/2006 | Burris et al. |
| 7,131,868 | B2 | 11/2006 | Montena |
| 7,156,560 | B2 | 1/2007 | Seeley |
| 7,156,696 | B1 | 1/2007 | Montena |
| 7,163,420 | B2 | 1/2007 | Montena |
| 7,189,115 | B1 | 3/2007 | Montena |
| 7,207,838 | B2 | 4/2007 | Andreescu |
| 7,264,502 | B2 | 9/2007 | Holland |
| 7,278,854 | B1 | 10/2007 | Robinette et al. |
| 7,303,435 | B2 | 12/2007 | Burris et al. |
| 7,309,255 | B2 | 12/2007 | Rodrigues |
| 7,347,729 | B2 | 3/2008 | Thomas et al. |
| 7,351,101 | B1 | 4/2008 | Montena |
| 7,357,672 | B2 | 4/2008 | Montena |
| 7,458,851 | B2 | 12/2008 | Montena |
| 7,497,729 | B1 | 3/2009 | Wei |
| 7,566,243 | B1 | 7/2009 | Hung |
| 7,588,460 | B2 | 9/2009 | Malloy et al. |
| 7,993,159 | B2 | 8/2011 | Chawgo |
| 8,007,314 | B2 | 8/2011 | Chawgo et al. |
| 2005/0079761 | A1 | 4/2005 | Rodrigues |
| 2006/0014427 | A1 | 1/2006 | Islam et al. |
| 2006/0134979 | A1 | 6/2006 | Henningsen |
| 2006/0199431 | A1 | 9/2006 | Paynter |
| 2006/0246774 | A1 | 11/2006 | Buck |
| 2007/0149047 | A1 | 6/2007 | Wild et al. |
| 2007/0270032 | A1 | 11/2007 | Eriksen |
| 2008/0003873 | A1 | 1/2008 | Henningsen |
| 2008/0274643 | A1 | 11/2008 | Chawgo |
| 2009/0197465 | A1 | 8/2009 | Montena et al. |
| 2009/0233482 | A1 | 9/2009 | Chawgo et al. |
| 2010/0261381 | A1 | 10/2010 | Montena et al. |
| 2010/0261382 | A1 | 10/2010 | Montena et al. |

OTHER PUBLICATIONS

U.S. Appl. No. 13/174,697, filed Jun. 30, 2011; Conf. No. 1265.

COMPRESSION CONNECTOR FOR COAXIAL CABLE WITH STAGGERED SEIZURE OF OUTER AND CENTER CONDUCTOR

CROSS REFERENCE TO RELATED APPLICATION

This application is a continuation-in-part application of U.S. Ser. No. 11/743,633, entitled Compression Connector for Coaxial Cable, filed May 2, 2007, the entire contents of which are herein incorporated by reference.

FIELD OF THE INVENTION

This application generally relates to the field of coaxial cable connectors and more specifically to a compression connector for various types of coaxial cable, the connector including a mechanism for reliably seizing each of the center and outer conductors of an inserted prepared coaxial cable end in a sequential fashion.

BACKGROUND OF THE INVENTION

Coaxial cables are well known as a transmission medium that are installed on a widespread basis for purposes of carrying signals for communication networks, such as cable television (CATV) and computer networks, among others. A coaxial cable used for these purposes must, at some point, be connected to network connector parts. Typical coaxial cables are defined, such as 75 ohm and 50 ohm cables, by a center conductor, an outer conductor and an intermediate foam dielectric layer disposed therebetween, the outer conductor being covered by a protective sheath. The center conductor can be solid in terms of its construction or hollow as to various applications, thereby reducing material usage and stiffness. Coaxial cables can include smooth-walled and corrugated versions, depending on the application and signals to be carried.

When affixing a cable connector to a corrugated or other coaxial cable for termination thereof, it is necessary to provide both good electrical and mechanical contact between the cable connector and the center and outer conductors of the prepared coaxial cable end. Each of these types of coaxial cables face particular difficulties as to both mechanical and electrical interconnectivity, such as impedance matching, noise reduction and the like. It is also desirable to connect each of the center and outer conductors without having to reposition the cable connector during the connection operation. With regard to this, it may be required to seat the inner conductor first or alternatively seize the outer conductor first as opposed to attempting to seize each contemporaneously.

SUMMARY OF THE INVENTION

According to one aspect, there is described a compression connector for a coaxial cable, said coaxial cable comprising a center conductor, an outer conductor and a dielectric layer disposed therebetween, said connector comprising: a connector body having opposing first and second ends and a center passageway defined therethrough; an insulator disposed within said center passageway adjacent said first end of said connector; a compression sleeve movably connected to the second end of said connector body; first means disposed in the center passageway for seizing said outer conductor; and second means disposed in the center passageway for seizing said center conductor. The compression sleeve is axially movable from the second end to the first end of the connector body to cause the first and second means to sequentially engage the cable such that seizure of the outer conductor of the cable occurs either before or after seizure of the center conductor.

In one version, the outer conductor of the prepared coaxial cable is seized prior to the center conductor. In another version of the herein described compression connector, the center conductor is seized prior to the outer conductor.

In one version, a clamp is provided to seize the outer conductor, the clamp including an outer portion in contact with an interior surface of the connector body. The clamp is caused to translate axially with the compression sleeve wherein the interior surface of the connector body includes a first diameter and a narrower second diameter separated by a transitional area. When the clamp is axially translated and traverses the transitional area, the clamp is caused to compress inwardly thereby seizing the outer conductor of the coaxial cable.

The insulator retains a hollow conductive pin within an axial opening. According to one version, the conductive pin includes a collet portion extending outside the insulator that receives the center conductor of a prepared coaxial cable. The axial movement of the compression sleeve causes engagement between a drive member and the collet portion, causing the collet portion to be advanced into the opening of the insulator, the latter being in fixed relation relative to the connector body. As the collet portion is axially advanced by the drive member, the collet portion seizes the center conductor.

According to another aspect, there is provided a compression connector for a coaxial cable end, said coaxial cable end comprising an exposed center conductor extending from a distal end, an exposed outer conductor extending over an axial portion adjacent said exposed center conductor and a dielectric layer disposed therebetween, said connector comprising a connector body having opposing first and second ends and a center passageway defined therethrough, said center passageway having a first diameter and a different second diameter linked by a transitional section. An insulator is disposed within the center passageway adjacent said first end of said connector, as well as a compression sleeve that is movably connected to the second end of the connector body. A clamp disposed in relation to said compression sleeve is mounted for axial movement within the center passageway, said clamp having an external surface in contact with the interior surface of said center passageway and an internal surface that is configured for engagement with the center conductor of an engaged cable end. The connector also includes a conductive member disposed in an axial opening of said insulator, said conductive member having means for seizing said center conductor, said compression sleeve being axially movable from said second end to said first end to cause said clamp and said conductive member to sequentially engage the outer and center conductors of said cable and in which seizure of said outer conductor occurs either before or after seizure of said center conductor.

In one version, the means for seizing the center conductor includes a collet portion provided at one end of the conductive member. The collet portion is made up of a plurality of flexible fingers, the collet portion being disposed outside of the insulator. According to one embodiment, the collet portion is defined by a transition diameter that is tapered, this diameter being greater than that of the insulator opening. A drive element disposed in relation to the clamp engages and causes the collet portion to be driven into the insulator opening, closing the collet portion and thereby seizing the center conductor.

In yet another version, the means for seizing the center conductor includes a plurality of spring contacts that are disposed within the hollow interior of the conductive member. The conductive member is disposed within the insulator opening such that the center conductor is seized when the cable end is advanced a predetermined distance therein. In the instance of coaxial cables having more than one center conductor, a plurality of conductive pins are provided, each having the seizing means.

The positioning of the transitional surface and the drive element are arranged within the connector body so as to stagger or sequentially permit seizure of either the center conductor or the outer conductors of a prepared coaxial cable end. For example, the insulator can be fixedly attached in one version in which the clamp engages the outer conductor first and then the inner conductor. In another version, the insulator is movably disposed to permit seizure of the inner conductor by the insulator and then permit the clamp to engage the outer conductor.

The above compression connector design is applicable for use with various types of coaxial cable, including but not limited to spiral corrugated, corrugated and smooth-walled coaxial cables.

According to yet another aspect, there is provided a connector for a coaxial cable end, said coaxial cable end comprising an exposed center conductor extending from a distal end, an exposed outer conductor extending over an axial portion adjacent said exposed center conductor and a dielectric layer disposed therebetween, said connector comprising a connector body having opposing first and second ends and a center passageway defined therethrough, said center passageway having a first inner diameter and a different second inner diameter linked by a transitional section; an insulator disposed within said center passageway adjacent said first end of said connector; a compression sleeve movably connected to the second end of said connector body; a clamp disposed in relation to said compression sleeve and mounted for axial movement within said center passageway, said clamp having an external surface in contact with the interior surface of said center passageway and an internal surface that is configured for engagement with the center conductor of an engaged cable end; and a conductive member disposed in an axial opening of said insulator, said conductive member having means for seizing said center conductor, said compression sleeve being axially movable from said second end to said first end to cause said clamp and said conductive member to sequentially engage the outer and center conductors of said cable and in which seizure of said outer conductor occurs either before or after seizure of said center conductor; a conductive member disposed in an axial opening of said insulator, said conductive member including at least one seizing element for seizing said center conductor, said compression sleeve being axially movable from said second end toward said first end to cause said clamp and said at least one seizing element to sequentially engage the outer conductor and inner conductors of said coaxial cable.

An advantage is that a compression connector has been developed in which the center conductor can be secured out of sequence with that of the ground, which may be desirable in some attachment situations. For example, in the instance the coaxial cable were "live" at the time of connection, such sequencing would be preferable.

These and other features and advantages will become readily apparent from the following Detailed Description, which should be read in conjunction with the accompanying drawings.

DETAILED DESCRIPTION

Figure 1A:
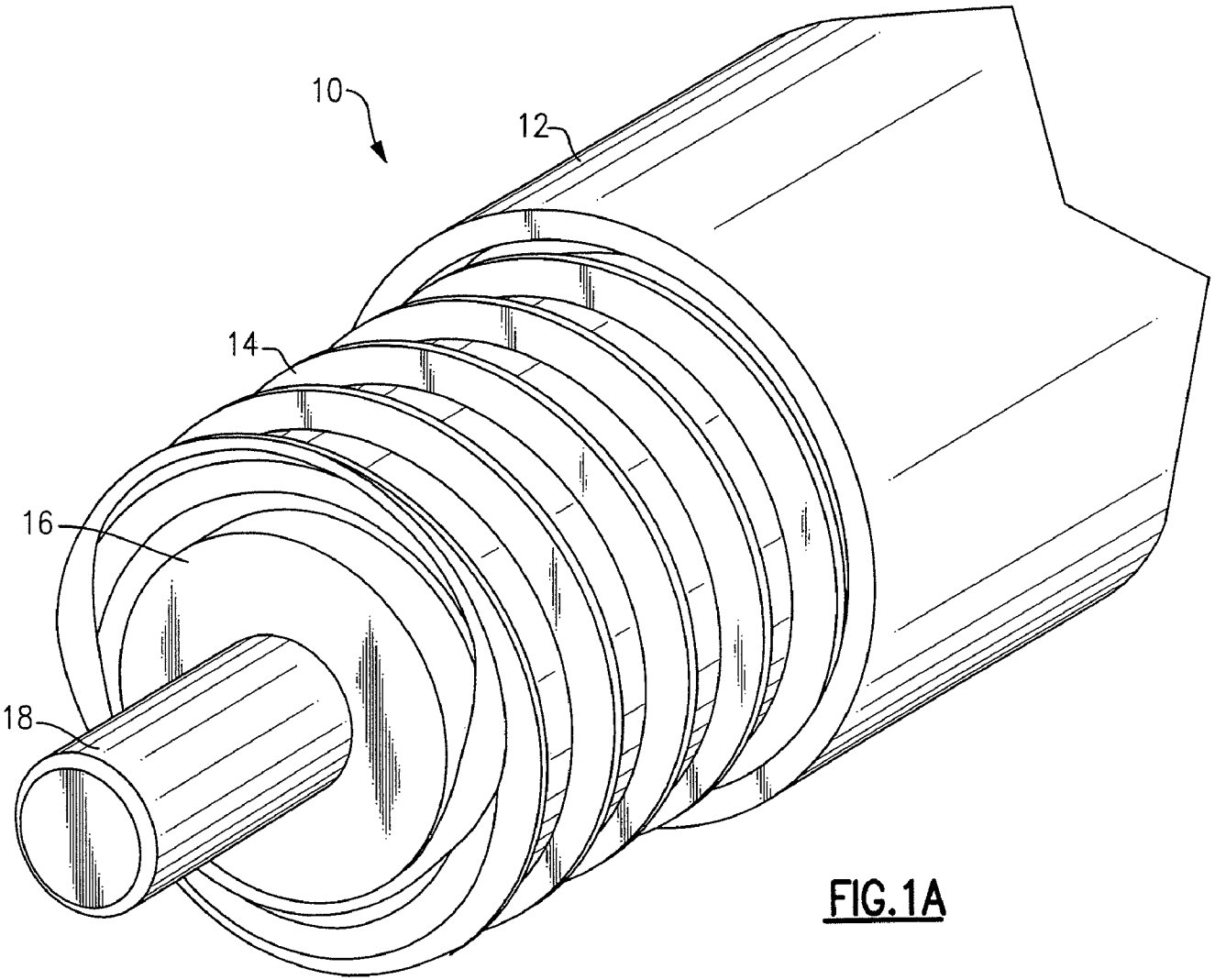
FIG. 1(A) is a perspective view of a spiral corrugated coaxial cable having an end prepared for engagement with coaxial cable connector.

The following description relates to certain exemplary embodiments of a compression conductor for use with various types of coaxial cable, including corrugated, spiral corrugated and smooth-walled coaxial cables. Throughout the course of this description, various terms are used in order to provide a suitable frame of reference with regard to the accompanying drawings. These terms, however, are not intended to constrict the definition or scope of the present invention, unless so specifically noted.

Turning to FIGS. 1(A)-1(E) and in order to provide a suitable background, there are depicted exemplary coaxial cables having cable ends that have been prepared for installation into a compression connector. Referring first to FIG. 1(*a*), an exemplary prepared spiral corrugated coaxial cable 10 is defined by a center conductor 18 that is surrounded by an intermediate dielectric layer 16. An outer insulative jacket 12 is cut away to expose an axial section of a corrugated conductor layer 14 consisting of a plurality of protrusions and valleys formed in a spiral configuration. This layer 14 is also known and referred to throughout as the ground or outer conductor layer. Both the spiral corrugated conductor layer 14 and a portion of the intermediate dielectric layer 16 are cut away at the distal end of the cable 10, exposing an axial section of the exposed center conductor 18.

Figure 1B:
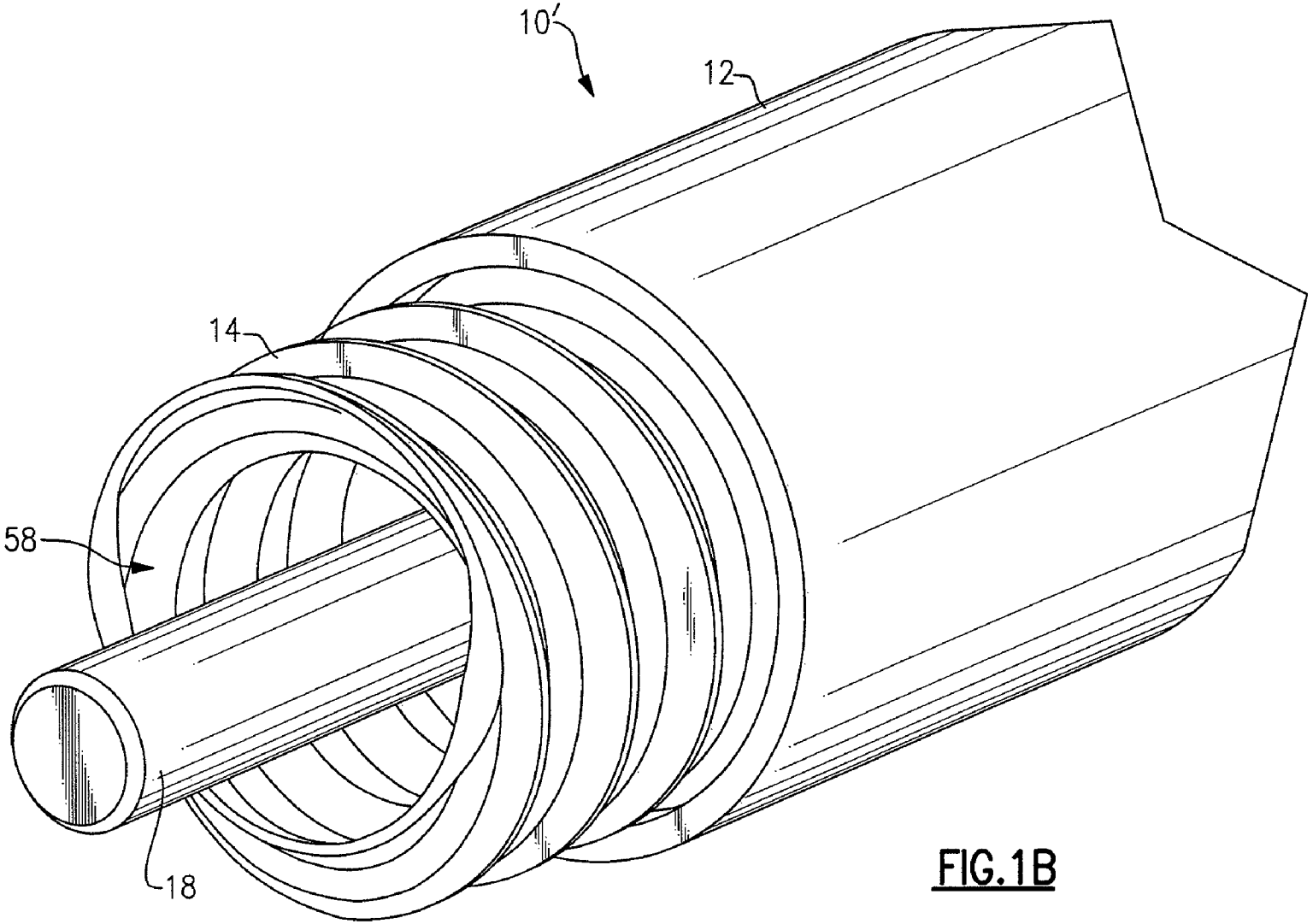
FIG. 1(B) is a perspective view of the spiral corrugated coaxial cable of FIG. 1(A) with a portion of the dielectric layer removed.

Another spiral corrugated coaxial cable 10' end is shown for termination onto a compression conductor in FIG. 1(B). In addition to the outer insulative jacket 12 being cut away to expose an axial portion of the spiral corrugated conductor layer 14, the intermediate dielectric layer 16 is cored out leaving a hollow 58 extending beneath the outer conductor layer after both the corrugated conductor layer 14 and the dielectric layer 16 have been cut away from the center conductor 18.

Figure 1C:
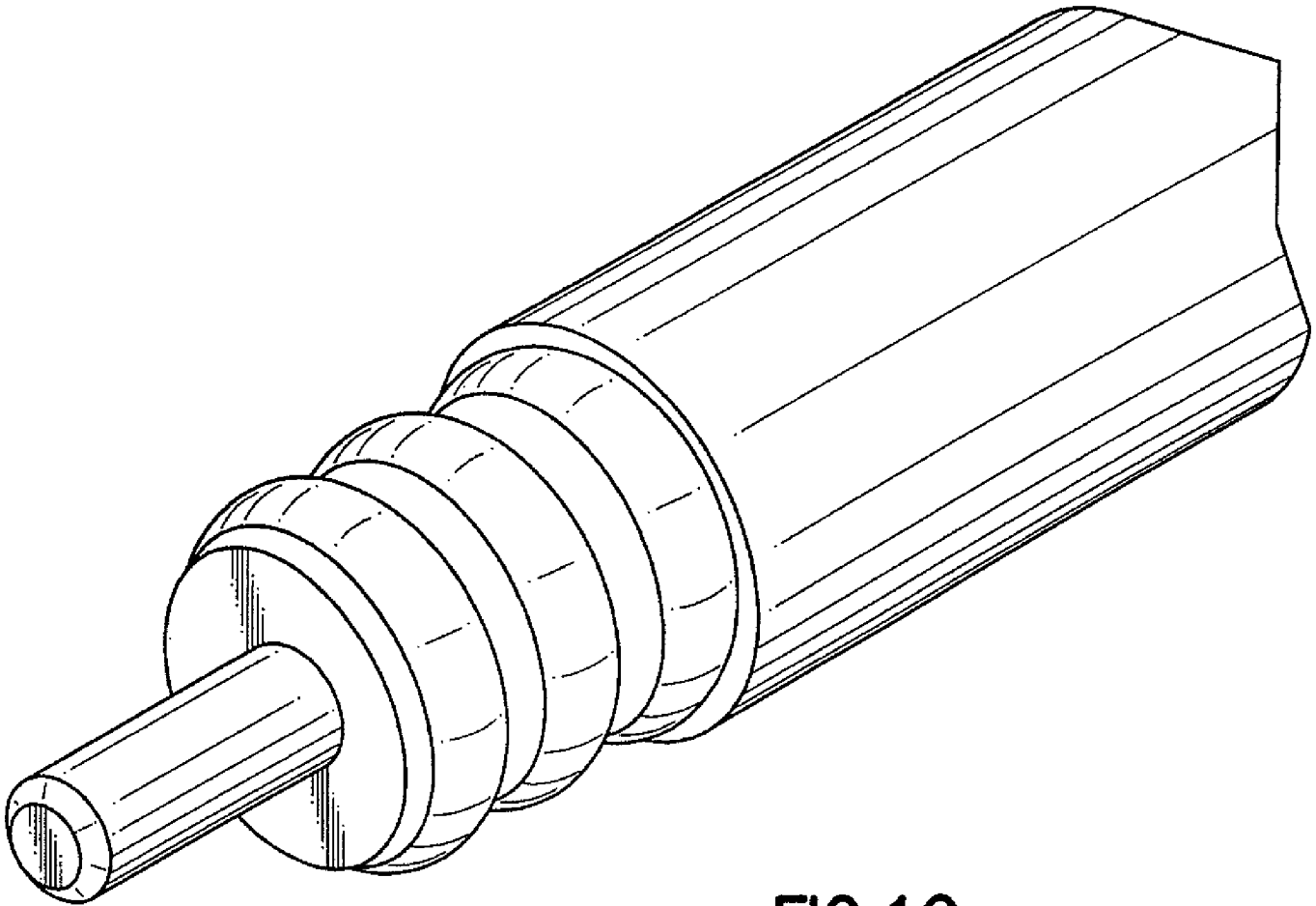
FIG. 1(C) is a perspective view of an annular corrugated coaxial cable having an end prepared for engagement with a coaxial cable connector.

Referring to FIG. 1(C), a non-spiral corrugated coaxial cable 10" is shown prepared for installation onto a compression conductor. This section of cable also includes an outer insulative jacket 12 that is cut away to expose an axial section of an outer corrugated layer 14", this layer being made up of a plurality of annular corrugations with valleys or slots therebetween. As in the preceding, the outer conductor layer 14" and intermediate dielectric layer 16 are also cut away to expose a center conductor 18 defining the distal end of the prepared cable 10".

Figure 1D:
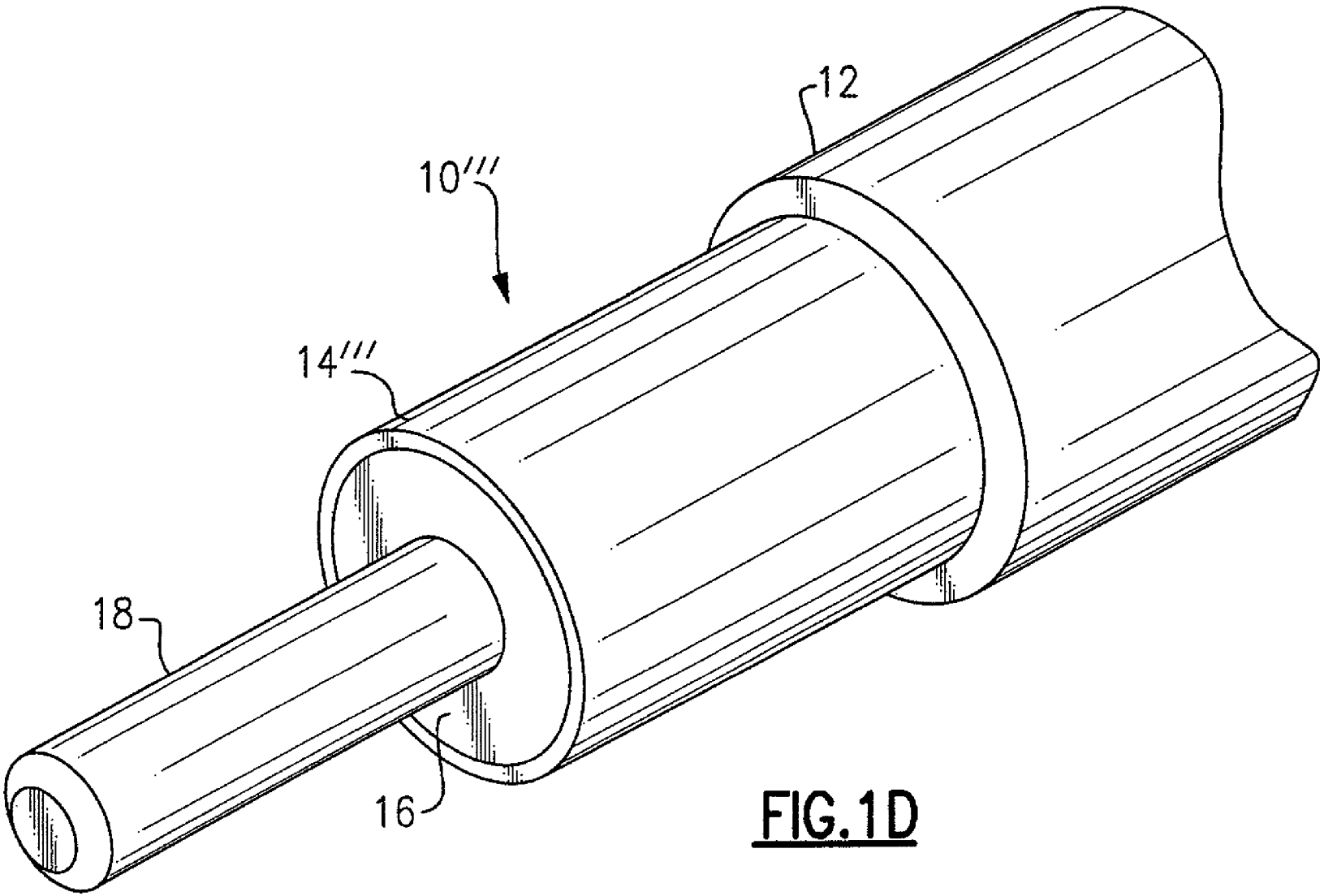
FIG. 1(D) is a perspective view of a smooth-walled coaxial cable having an end prepared for engagement with a coaxial cable connector.

FIG. 1(D) illustrates a smooth-walled coaxial cable 10''' also defined by an outer insulative jacket 12 that is cut away to expose an outer conductor layer 14''', the latter being different than each of the preceding versions in that this layer is defined by a smooth annular surface having no corrugations. As in the preceding, the outer conductive layer 14''' and the intermediate dielectric layer 16 are each cut away at the distal end of the cable to expose the center conductor 18.

Figure 1E:
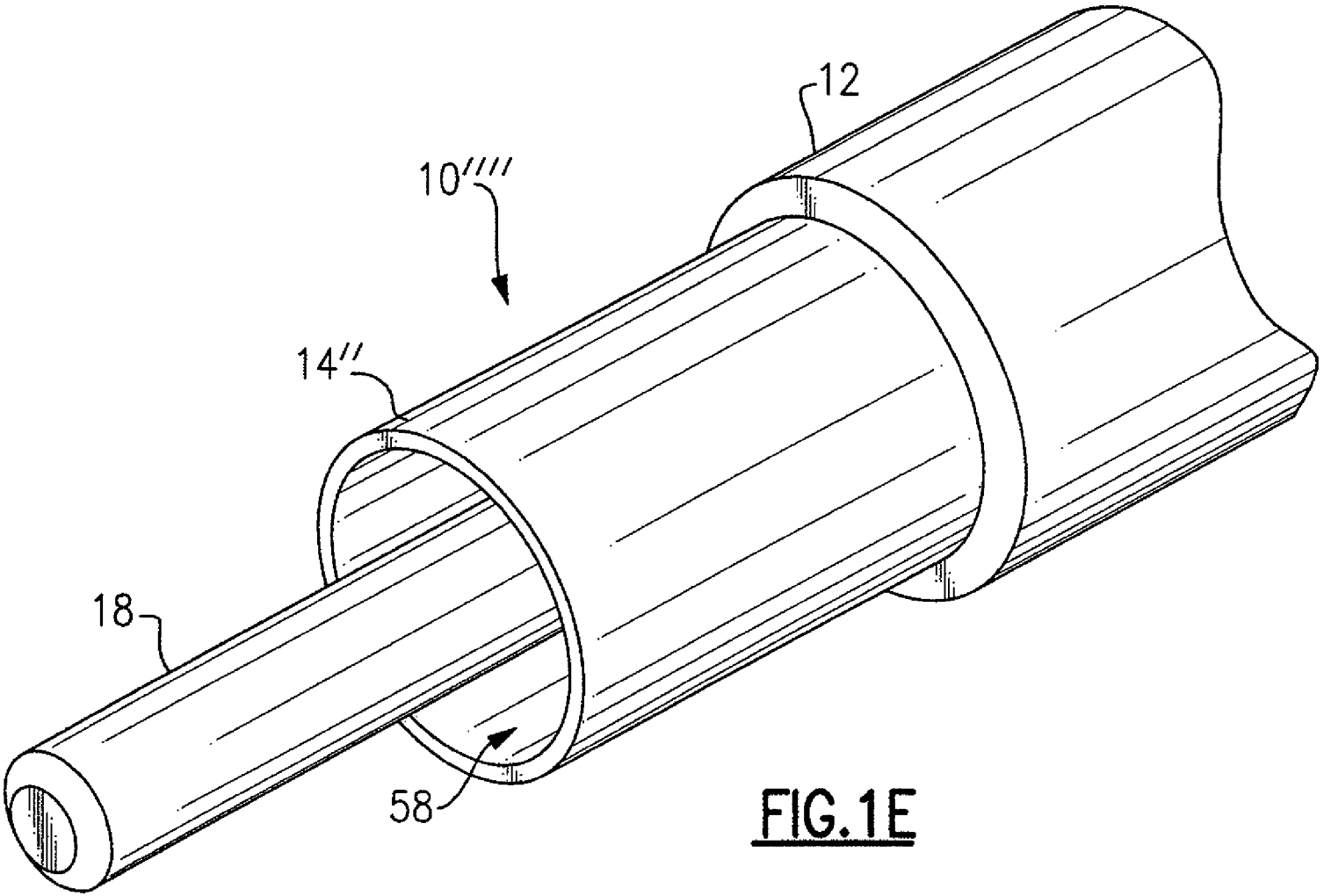
FIG. 1(E) is a perspective view of the smooth-walled coaxial cable of FIG. 1(D) with a portion of the dielectric layer removed.

FIG. 1(E) depicts another smooth-walled coaxial cable version 10''''. Like the preceding versions, the cable 10'''' includes an outer insulative jacket 12, an outer conductive layer 14" like that of FIG. 1(D), and a center conductor 18 in which the intermediate dielectric layer 16, FIG. 1(D), is cored to define a hollow 58. Each of the foregoing cables are described with a solid center conductor. However and as noted above, the center conductor pin can alternatively be hollow. Cables having either form of center conductor can be used in conjunction with this application.

Referring to FIGS. 2-5, a compression connector 20 made in accordance with a first embodiment is shown in a partially compressed position, the connector being defined by a body 22 having a nut 24 that is rotatably secured to one end 41 of the body according to this embodiment via an annular flange 26. An insulator 28 that is disposed within a defined center cavity or passageway 23 of the compression body 22 adjacent to the distal end 41 positions and retains a conductive pin 30 within a defined opening 56. The insulator 28 is fixedly disposed within the center passageway 23 according to this embodiment wherein an annular shoulder 47 engages the top surface of a cylindrical retaining section 27 of the connector body 22, the retaining section having a defined bore into which a distal portion of the insulator is snugly fitted.

At least a portion of the conductive pin 30 is hollow, the pin being defined by a pin portion 32 and a collet portion 34 at opposing ends, the pin extending through the insulator opening 56 with the collet portion 34 extending outwardly from the insulator 28. The collet portion 34 includes a set of electrically conductive contacts surrounded by a plurality of flexible finger sections or tines. A drive insulator or mandrel 36 is positioned for axial movement within the center passageway 23 between the collet portion 34 and a clamp 38, the mandrel having a through opening 37 that is axially aligned with the insulator opening 56.

In this version, the mandrel 36 includes a surface facing the proximal body end 42 that is essentially planar such that this surface can engage the dielectric layer 16 of an inserted cable end 10, FIG. 1(A), and the clamp 38. In an alternate version, such as when a cable 10", FIG. 1(B), is used, the surface of the mandrel 36 can include an extending portion (not shown) that is sized to extend into the hollow 58 of the cable. Such a version is shown in commonly owned and co-pending U.S. Ser. No. 11/743,633, the relevant portions being incorporated by reference herein.

In terms of assembly, the clamp 38 is positioned proximally from the drive mandrel 36 and is defined by a body made from a compliant material and having an interior annular surface 45 that is geometrically congruent to that of the spiral corrugations of the outer conductor layer 14 of the coaxial cable 10. That is, the interior annular surface 45 is defined by a plurality of protrusions and notches formed in a spiral configuration matching those of the outer conductor layer 14 of the coaxial cable 10. Referring to the exploded view of FIG. 5, a plurality of slots 39 are formed in an outer annular portion of the clamp, thereby permitting the clamp 38 to be compressed or squeezed radially inward under the application of an inwardly directed radial force. The clamp 38 is fitted within the center passageway 23 of the body 22 such that the outer annular surface 43 of the clamp is in intimate contact with the interior surface of the body 22, but allowing for axial movement thereof.

The compression sleeve 40 is defined by an exterior portion formed over an axial section of the connector body 22, as well as an extending drive portion 44 that engages into the connector 20 against an annular flange 46 of a drive ring 48, the latter being fitted between the clamp 38 and the compression sleeve and including an annular slot sized to receive the periphery of the connector body 22. An annular seal element 50 made preferably from an elastomer fits snugly against the outer insulative jacket 12 of the prepared coaxial cable 10 during installation to prevent external environmental influences (i.e., moisture, grit, etc.) from entering the interior of the compression connector 10.

Figure 2:
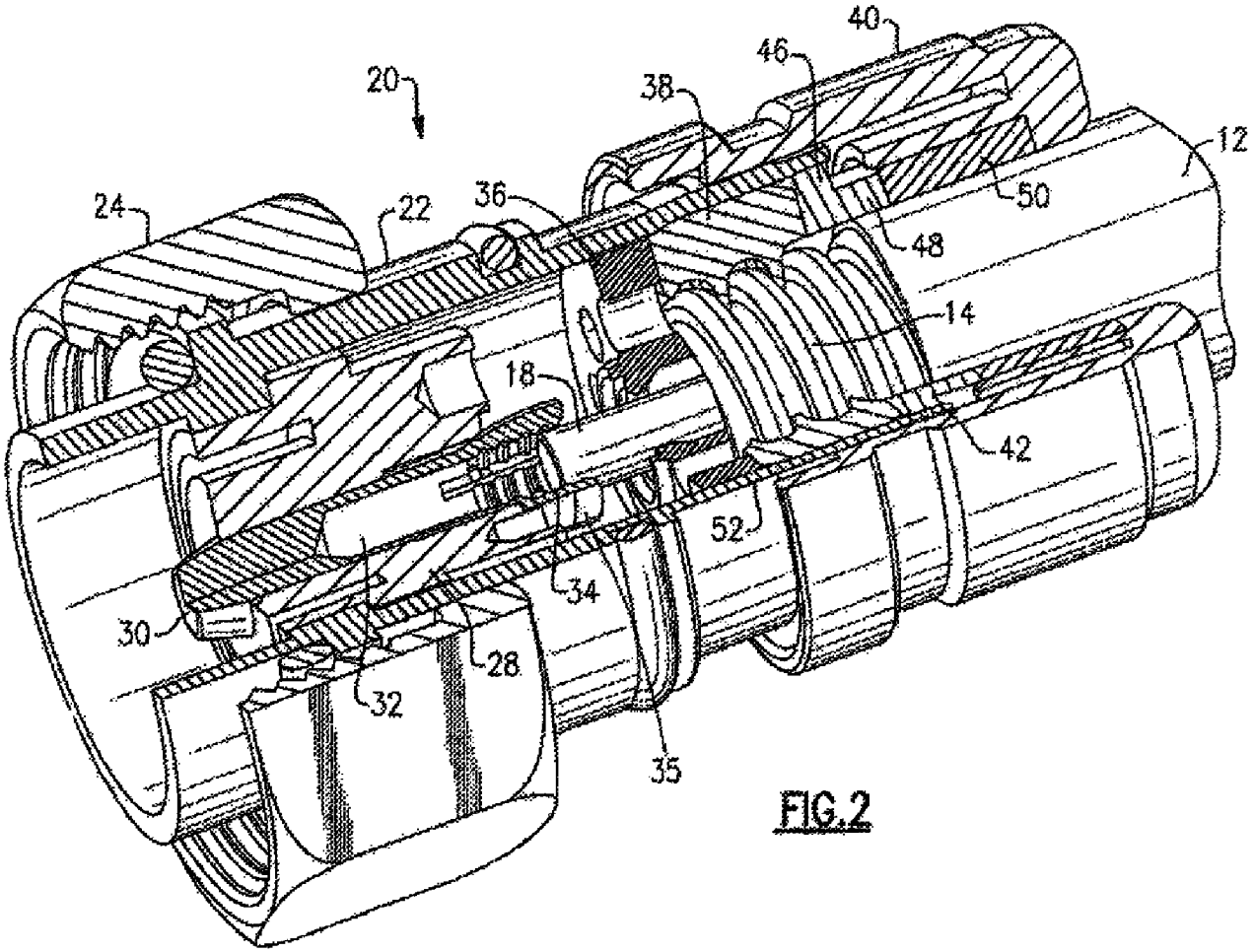
FIG. 2 is a sectioned side perspective view of a coaxial cable connector in accordance with one exemplary embodiment, illustrating a coaxial cable of FIG. 1(B), the connector being shown in an initially compressed position.

Referring to FIG. 2, the end of the prepared spiral corrugated coaxial cable 10, FIG. 1(A), is initially inserted into an opening 54 on the proximal end 42 of the connector 20 and into the center passageway 23 of the body 22 using a compression tool (not shown). During this initial insertion, the spiral corrugated cable 10 is initially twisted as it is inserted such that the spirals on the outer conductor layer 14 fit into the spirals in the interior annular portion of the clamp 38. At the same time, sufficient axial displacement has occurred in the direction shown by arrow a, permitting the center conductor 18 to advance along the central passageway 23, through the opening 37 in the mandrel 36 and into the collet portion 34 of the extending hollow conductive pin 30.

It should be noted that the connector 20 is retained in a fixed and immovable position while the compression tool is in engagement therewith and during the time compressive force is applied in the direction shown by arrow a. Compression tool designs are known in the field to accomplish this type of stabilization and do not form an essential part of the present invention.

Figure 3:
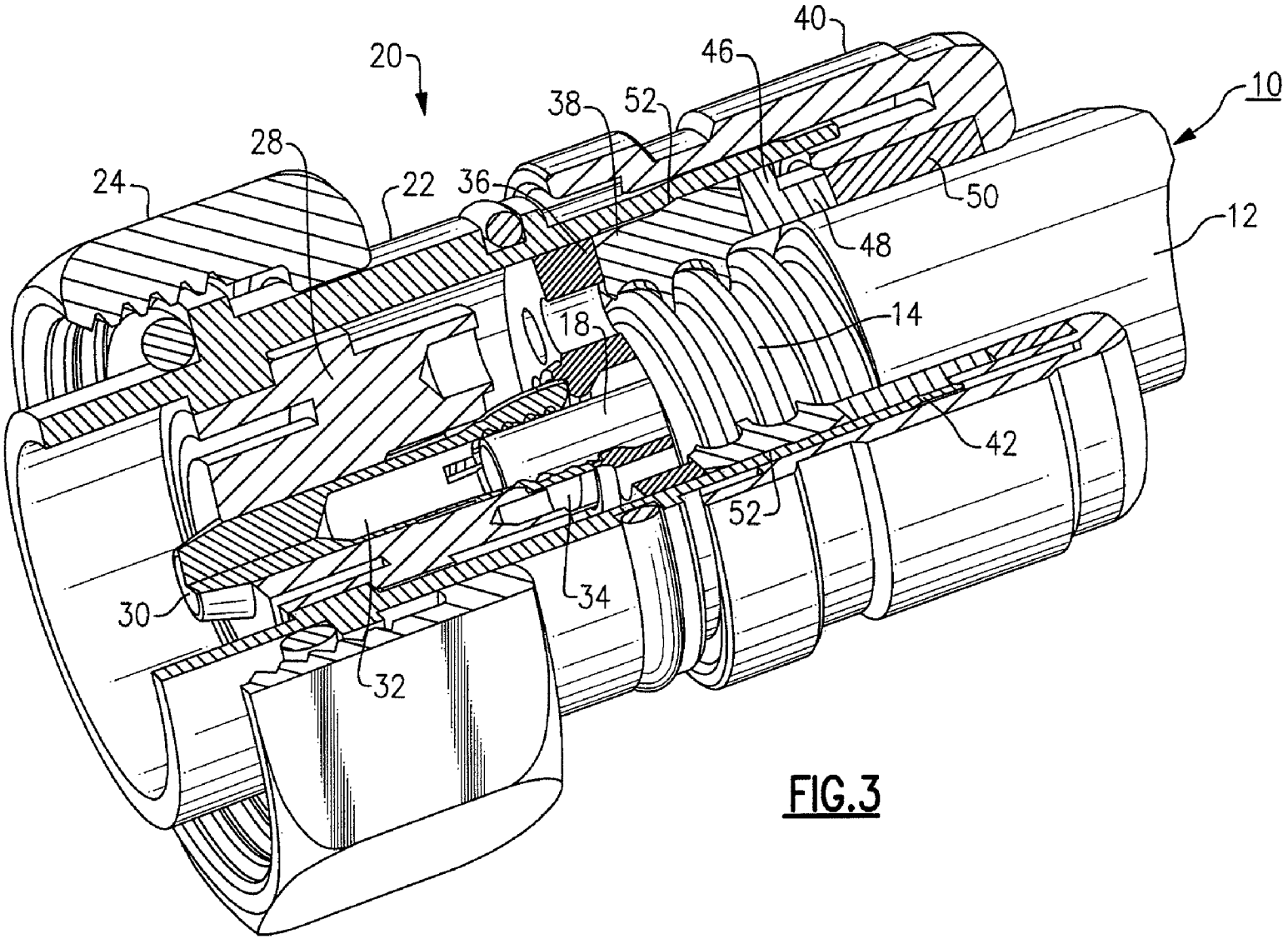
FIG. 3 is a sectioned side perspective view of the coaxial cable connector of FIG. 1(B), as shown in an intermediate engagement position.

Referring to FIG. 3 and following initial engagement, the clamp 38 advances axially per the direction shown by arrow a into the transitional surface area 52 of the connector body 22 and subsequently the smaller interior diameter of the center passageway 23. Due to the inclusion of the formed slots 39, FIG. 5, and by also manufacturing the clamp 38 from a relatively compliant material, the clamp is able to maintain contact with the interior surface of the connector body 22 and to elastically inwardly (radially) compress with respect to the primary axis of the body. This compression causes the interior annular surface 45 of the clamp 38 to engage directly or seize against the spirals of the outer conductor layer 14.

Figure 4:
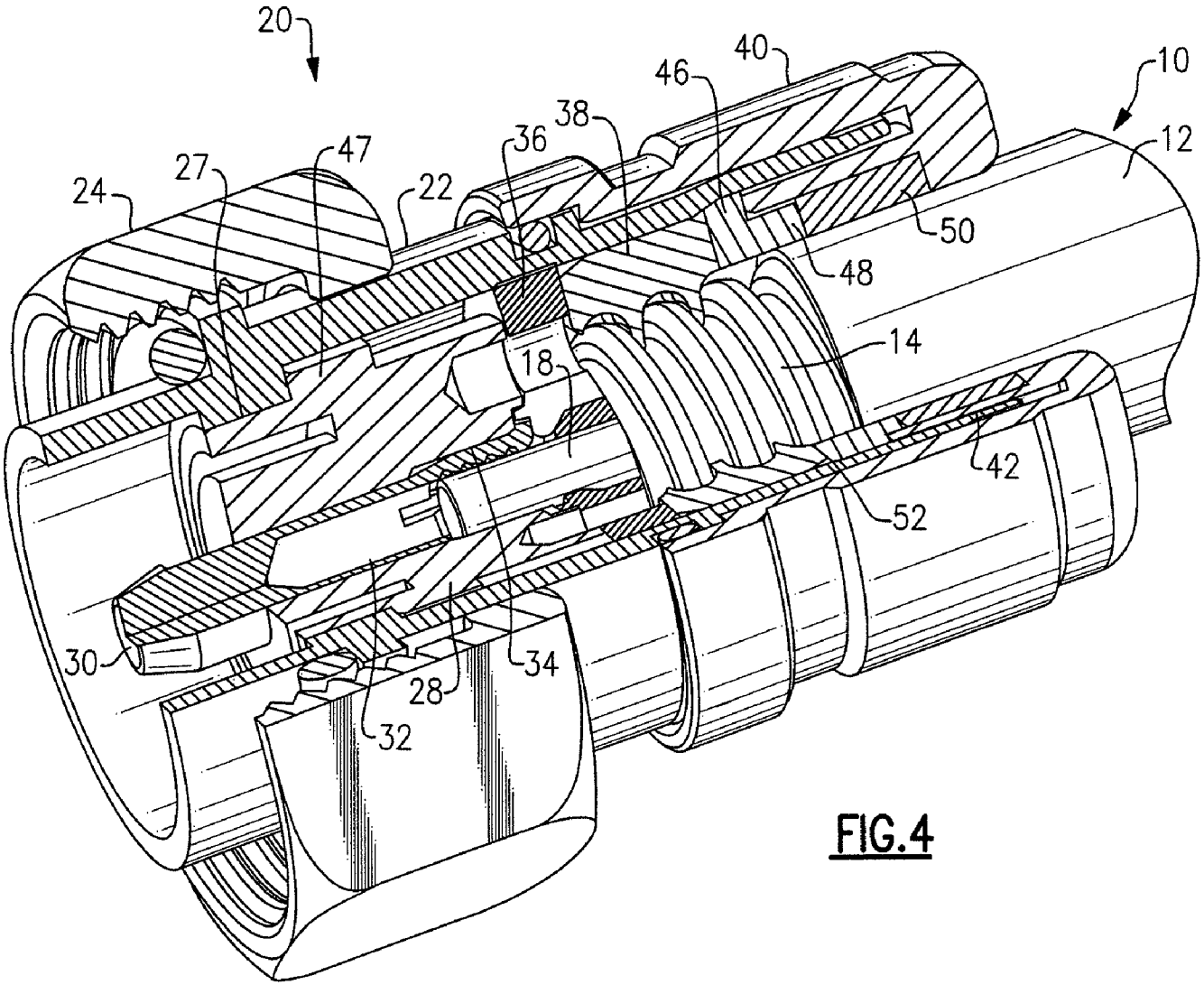
FIG. 4 is the sectioned side perspective view of the coaxial cable connector of FIG. 2, illustrating the connector in a fully engaged position.
Figure 5:
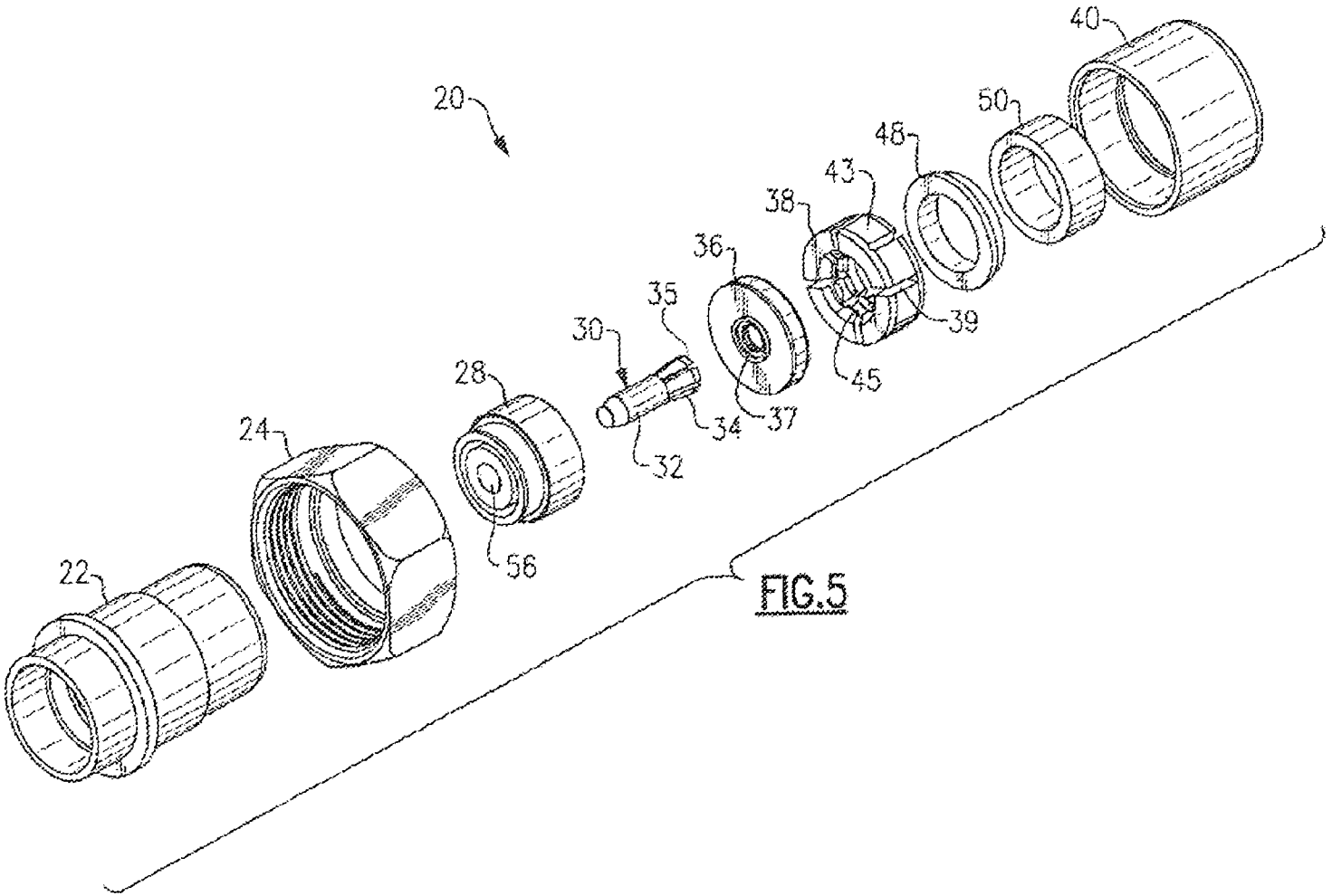
FIG. 5 is an exploded assembly view of the coaxial cable connector of FIGS. 2-4.

As shown in FIG. 4, further movement of the compression sleeve 40 and clamp 38 causes the drive mandrel 36 to axially advance in the direction shown by arrow a. This movement engages the distal surface of the mandrel 36 directly against the end of the collet section 34, causing the collet portion of the hollow conductive pin 30 to also axially advance into the defined opening 56 of the fixedly mounted insulator 38. Because the diameter of the insulator opening 56 is smaller than the outer diameter of the ramped exterior surface 35 of the collet portion 34, this axial movement causes the electrical contacts disposed within the flexible finger sections 35 of the collet portion 34 to radially squeeze onto and permanently seize the center conductor 18 as shown in FIG. 4. Because the exposed center conductor 18 of the prepared cable end 10, FIG. 1(A), has already advanced into the conductive pin 30, the conductor does not move axially relative to the pin during this phase of the clamping or seizing process.

Figure 6:
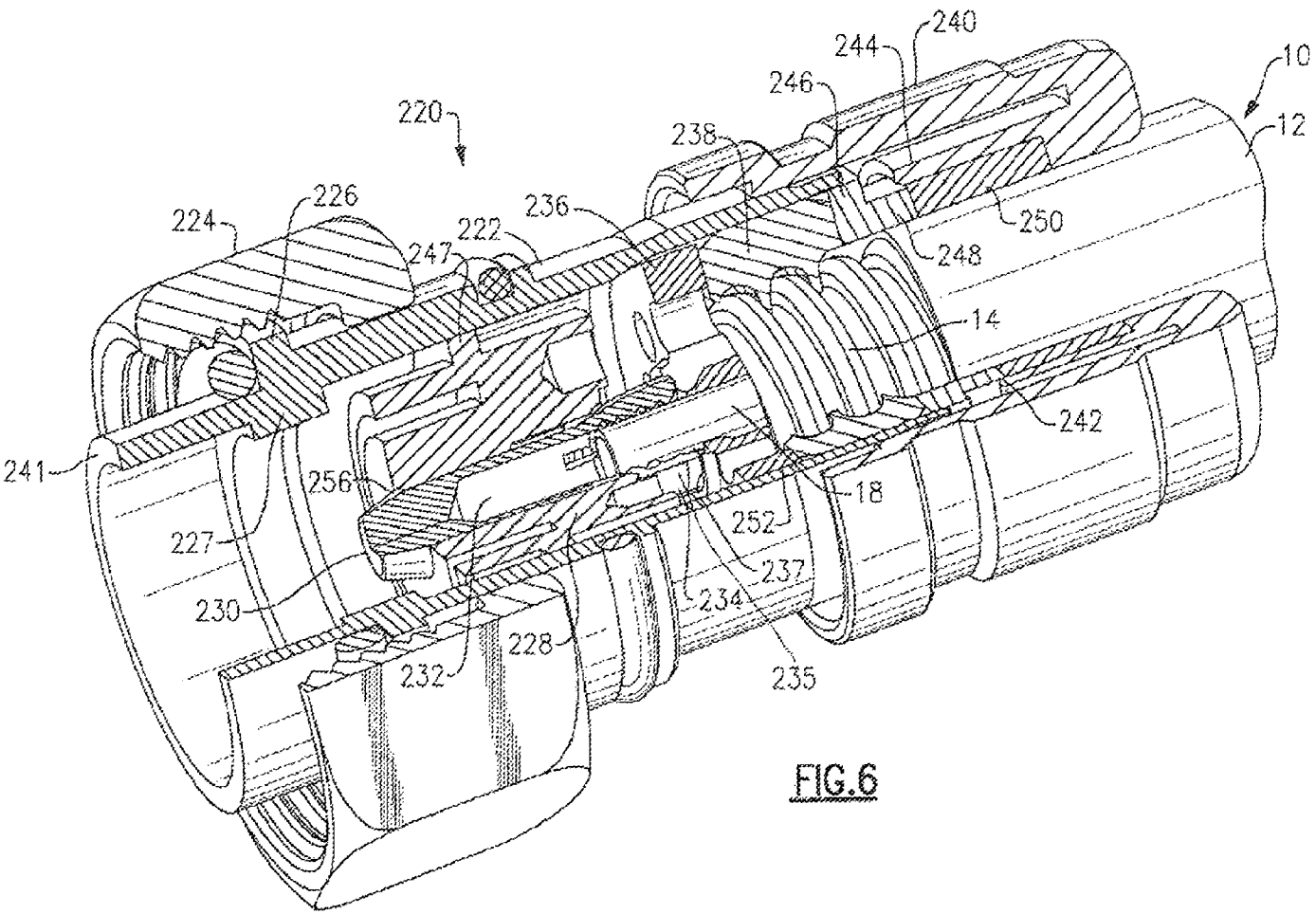
FIG. 6 is a sectioned side perspective view of a coaxial cable connector made in accordance with another exemplary embodiment, having a coaxial cable end installed as shown in FIG. 1(B), the conductor being shown in a partially engaged position.
Figure 7:
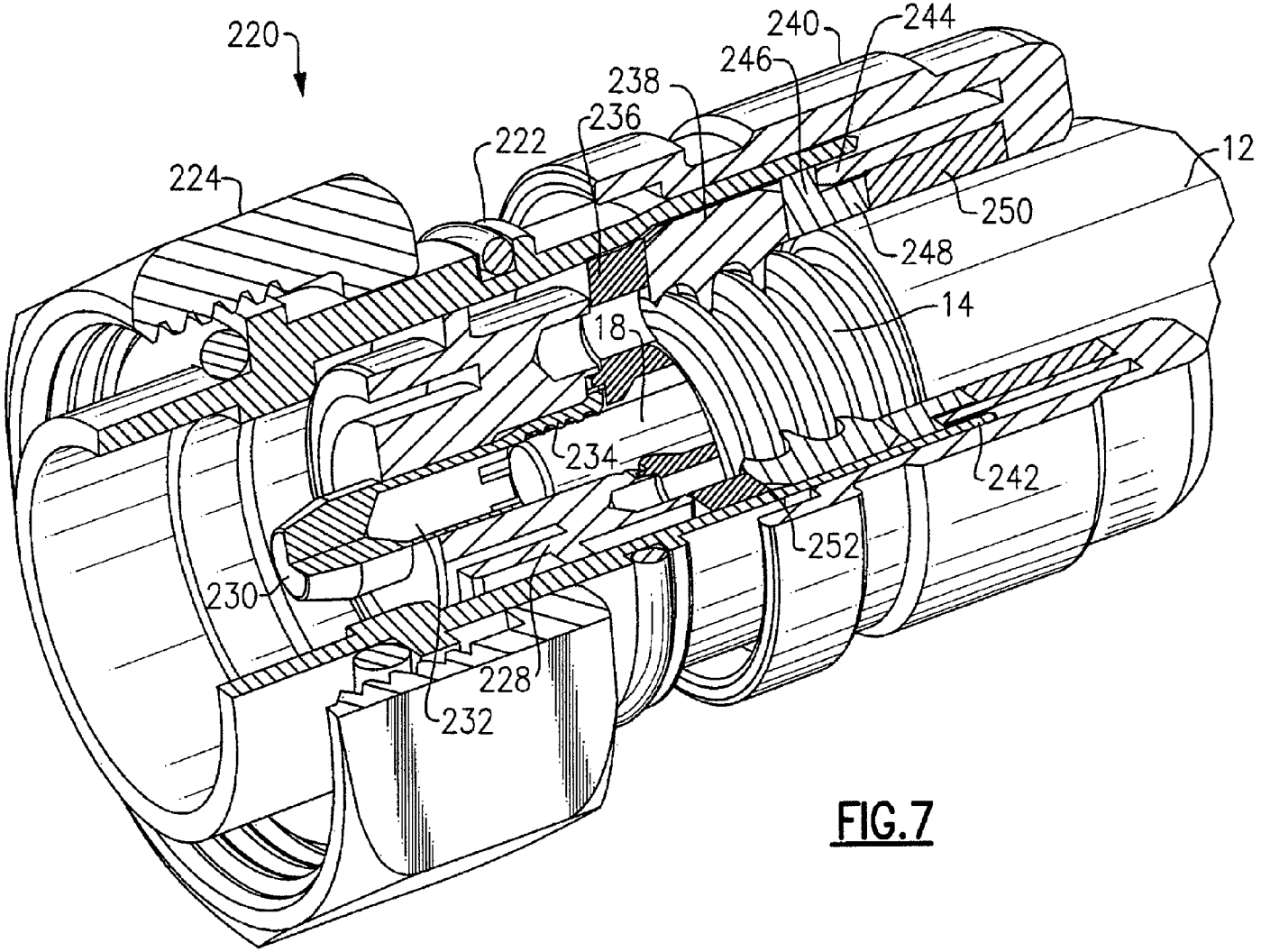
FIG. 7 is the side sectioned perspective view of the coaxial cable connector of FIG. 6, illustrated in an intermediate engaged position.
Figure 8:
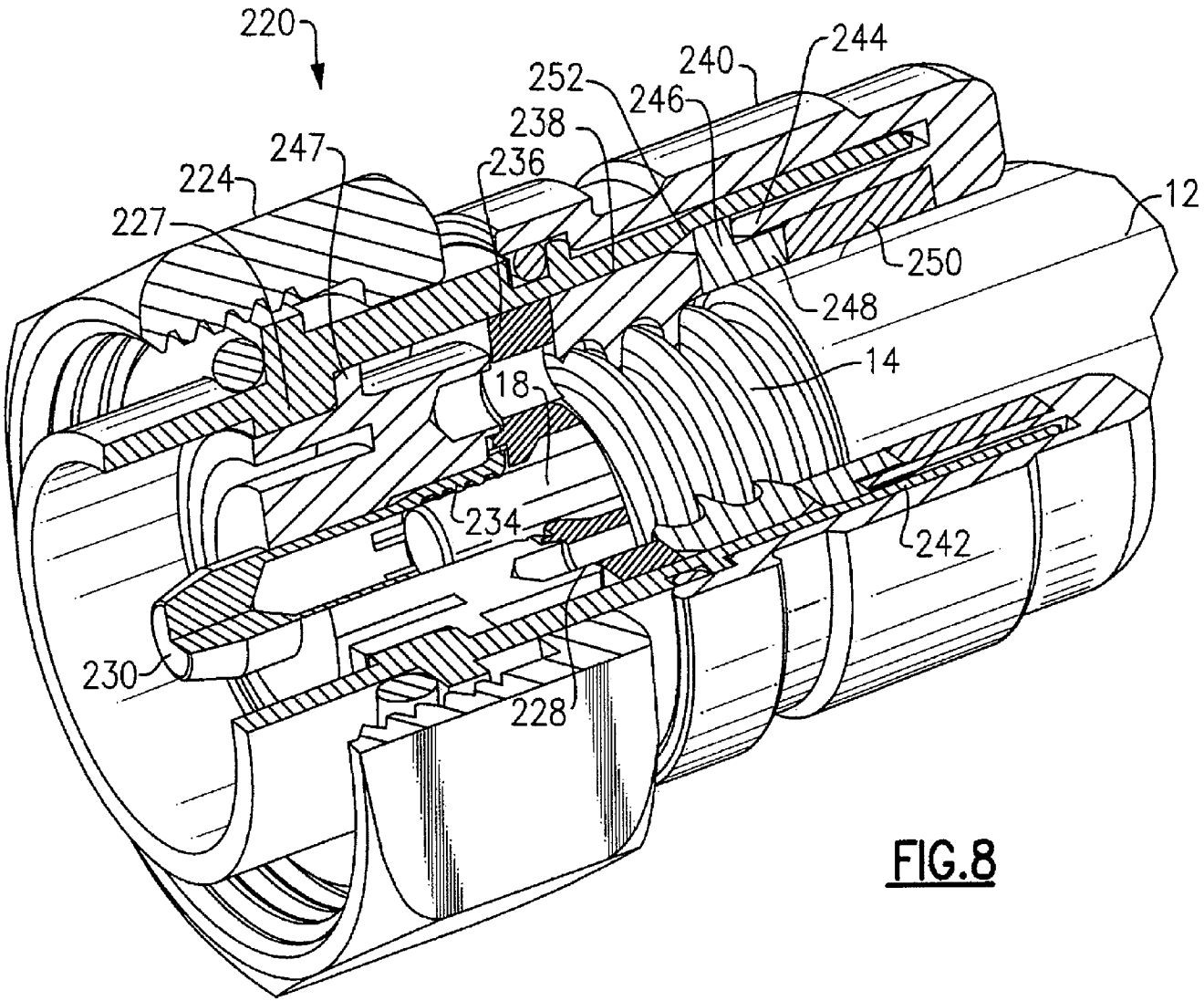
FIG. 8 is the side sectioned perspective view of the coaxial cable connector of FIGS. 6 and 7, shown in a fully engaged portion.

FIGS. 6-8 depict an alternative embodiment of a compact compression connector 220 made in accordance with the present invention. In this embodiment, the center conductor 18 of a prepared cable end 10, FIG. 1(A), is seized in advance of the outer conductive layer 14.

The compression connector 220 according to this embodiment is defined by a body 222 that includes a center cavity or passageway 223, the body having adjacent axial sections with different interior diameters that are separated by a transitional section or area 252. This transitional area 252 can be defined by a ramped, convex, concave or other shaped configuration that provides gradual demarcation. The connector 220 further includes a nut 224 rotatably secured to a distal end 241 of the body 222 by means of an annular flange 226. It should be noted that the nut is used on the end 241 of the connector, though it will be readily apparent that other means could be provided for securing same (not shown). An insulator 228 disposed within the center passageway 223 of the connector body 222 positions and holds a hollow conductive pin 230 within a defined opening 256. In this version, the insulator 228 is movably supported within the center passageway 223, wherein an annular shoulder 247 of the insulator is in spaced axial relation to a cylindrical retaining section 227 of the connector body 222, the retaining section having a defined bore that is sized snugly to receive a distal portion of the insulator.

The hollow conductive pin 230 includes a pin portion 232 and a collet portion 234 at opposing ends, the collet portion 234 being made up of a set of electrical contacts disposed within a plurality of flexible finger sections 235 or tines extending outwardly through the insulator opening 256. A drive insulator or mandrel 236 is positioned within the center passageway 223 between an end of the collet portion 234 and a clamp 238, the mandrel having a through opening 237 that is axially aligned with the insulator opening 256. The mandrel 236 can include a proximal surface that includes an extending portion sized to engage a hollow 58, FIG. 1(B), of a cored cable end or as per this embodiment, the mandrel includes a substantial planar distal surface that engages the intermediate dielectric layer 16, FIG. 1(A), and clamp 238, as described below.

The clamp 238 is defined by an interior annular surface 245 that is geometrically congruent to the spiral corrugations of the outer conductor layer 14 of the coaxial cable 10, FIG. 1(A). As in the preceding, the clamp 238 also preferably includes a plurality of slots (not shown) that are formed in an outer annular portion of the clamp, such that the clamp 238 can be compressed or squeezed radially inward, the outer annular portion being initially fitted in intimate contact with the interior surface of the body 222. A compression sleeve 240 is attached to the opposite end 242 of the body 222, the sleeve being configured for axial movement along with the clamp 238 and an annular elastomeric seal element 250.

The compression sleeve 240 includes a drive portion 244 that fits against an annular flange 246 of a drive ring 248 fitted between the clamp 238 and the compression sleeve. As in the previous version, the annular elastomeric seal element 250 fits snugly against the outer insulative jacket 12 of the corrugated coaxial cable 10 during installation thereof in order to prevent external environmental influences (i.e., moisture, grit, etc.) from entering the interior of the compression connector 10.

Referring to FIG. 6 and in operation, the prepared end of a coaxial cable 10, FIG. 1(B), is inserted initially by means of a compression tool (not shown) into the opening 254 of the compression connector 220 but prior to full installation of the cable 10 within the connector. As in the preceding, the engaged spiral corrugated cable 10, FIG. 1(A), must initially be twisted in order to align the outer conductor layer 14 with the features of the interior annular surface 245 of the clamp 238. However and in this embodiment and due to the spacing of the components, the exposed center conductor 18 extends through the opening 237 of the drive insulator 236 and fits within the collet portion 234 of the conductive pin 230 at this stage. The collet portion 234 surrounds the center conductor 18, but does not yet seize the center conductor 18 while in this position.

Referring to FIG. 7, a compression tool (not shown) then axially advances the compression sleeve 240 by known means along the body 222 in the direction shown by arrow a, such that clamp 236 and drive mandrel 236 each translate toward the distal end 241 of the connector body 222, causing the drive mandrel to impinge against the collet portion 234 and forcing the collet portion into the insulator opening 256. Due to the tapered transition surface 235 of the flexible collet portion 234, the conductive electrical contacts within the collet portion are caused to close as the flexible fingers are acted upon by the insulator opening, permanently engaging the contacts with the exposed center insulator 18 and seizing same. In this embodiment, the clamp 238 has not yet reached the transitional area 252 of the connector body 222, and therefore the clamp 238 has not yet seized the outer conductor layer 14. Referring to FIG. 8, and as the clamp 238 reaches the transitional area 252, the clamp is caused to compress based on the slots and the compliant nature of the connector body, wherein the interior annular surface 245 engages or seizes the outer corrugated conductor layer 14 of the prepared cable end. In the meantime, the insulator 228 is caused to axially translate along with the drive element 236 and clamp 238 until the annular shoulder 247 engages the top surface of the cylindrical retaining section 227, fixing the insulator in place.

Alternatively and in lieu of a flexible collet portion, the hollow conductive pin can be provided with a series of spring contacts as described in U.S. patent application Ser. No. 12/421,894, filed Apr. 10 2009, the relevant portions of which are herein incorporated by reference. In this instance, the hollow conductive pin is not movable within the insulator opening and therefore the mandrel is not required to create mechanical contact to drive the conductive pin into the opening of the insulator. That is, the insulator and mandrel can be manufactured as a single integral component. In this version, axial advancement of the center insulator of a prepared coaxial cable end proceeds using a compression tool or by hand to a predetermined distance within the connector, and within the conductive pin until the center conductor is engaged by a plurality of leaf springs that extend into the hollow opening of the conductive pin. At least two or more leaf springs are equally spaced from one another circumferentially, creating both electrical and mechanical contact with the exposed center conductor. For purposes of corrugated and smooth-walled coaxial cables, this form of connector can be utilized and performed in conjunction with a clamp or other means in which seizure of each of the center conductor and outer conductors is made in a sequential fashion.

Still further and according to alternative embodiments, other forms of coaxial cable can be utilized for use with the compression connector of the present invention. That is, smooth-walled and/or other corrugated coaxial cables can be used with clamp designs configured for seizing the outer conductor layer 14 of the cable 10, as described for example in U.S. Ser. No. 11/743,633, previously incorporated herein by reference in its entirety.

In addition to the foregoing and also in combination therewith, the herein described compression connector can be used with still other coaxial cable configurations. For example, the fixed insulator and drive mandrel can each include multiple axial aligned openings in order to accommodate a prepared coaxial cable end having multiple center conductors as described in co-pending U.S. patent application Ser. No. 12/421,826, Apr. 10, 2009, the entire contents of which are incorporated by reference. According to this version, annular and other forms of corrugated and smooth-walled coaxial cables can also have each of their outer and respective center conductors seized sequentially.

PARTS LIST FOR FIGS. 1-8

10 coaxial cable
10' coaxial cable
10" coaxial cable
10''' coaxial cable
10'''' coaxial cable
12 outer jacket
14 spiral corrugated conductor layer
16 dielectric layer
18 outer conductor
20 compression conductor
24 body
26 annular flange
27 cylindrical retaining section
28 insulator
30 conductive pin
32 pin portion
34 collet portion
36 drive insulator or mandrel
37 opening, mandrel
38 clamp
39 slots
40 compression sleeve
41 end, distal
42 end, proximal
43 external surface, clamp
44 drive portion
45 internal surface, clamp
46 annular flange
47 annular shoulder
48 drive ring
50 elastomeric seal element
52 transitional surface
54 opening
56 opening, insulator
58 hollow
220 compression connector
224 body, connector
226 annular flange
227 cylindrical retaining section
228 insulator
230 conductive pin
232 pin portion
234 collet portion
236 drive insulator or mandrel
237 opening, mandrel
238 clamp
239 slots
240 compression sleeve
241 end, distal
242 end, proximal
243 external surface, clamp
244 drive portion
245 internal surface, clamp
246 annular flange
247 annular shoulder
248 drive ring
250 elastomeric seal element
252 transitional surface
254 opening
256 opening, insulator It will be readily apparent that variations and modifications are possible that embody the intended inventive concepts, but without departing from the scope of the present invention as defined in the following claims.

The invention claimed is:

1. A compression connector for a coaxial cable end, said coaxial cable end comprising an exposed center conductor extending from a distal end, an exposed outer conductor extending over an axial portion adjacent said exposed center conductor and a dielectric layer disposed therebetween, said connector comprising:

a connector body having opposing first and second ends and a center passageway defined therethrough;

an insulator disposed within said center passageway adjacent said first end of said connector;

a compression sleeve movably connected to the second end of said connector body;

first seizure means disposed in the center passageway for seizing said exposed outer conductor; and second seizure means disposed in the center passageway for seizing said exposed center conductor, said compression sleeve being axially movable from said second end to said first end to cause said first seizure means and said second seizure means to sequentially engage said cable and in which seizure of said outer conductor occurs either before or after seizure of said center conductor.

2. A connector as recited in claim 1, wherein said interior surface of said center passageway is defined by a first axial section having a first inner diameter and a second axial section having a second inner diameter, said first and second axial sections being linked by a transitional surface section wherein said means for seizing said outer conductor includes a clamp which is caused to axially move with said cable end and said compression sleeve from said first axial section to said second axial section, said clamp having an interior surface that seizes said outer conductor when said clamp is axially moved from said first axial section.

3. A connector as recited in claim 1, wherein said means for seizing said center conductor is provided in a hollow conductive member disposed in said insulator, wherein seizure occurs when said center conductor is axially advanced a predetermined distance into an opening of said insulator.

4. A connector as recited in claim 3, wherein said means for seizing said center conductor includes at least one spring contact disposed within said hollow conductive member.

5. A connector as recited in claim 3, wherein said means for seizing said center conductor includes a flexible collet portion of said conductive member, said conductive member being a pin that is axially movable within said insulator opening, said opening having a diameter smaller than the diameter of said collet portion wherein said collet section is initially disposed externally relative to said insulator.

6. A connector as recited in claim 5, wherein said means for seizing said center conductor further includes a drive element disposed between said conductive pin and said compression sleeve, said drive element being axially movable to engage said collet portion and cause said conductive pin to move within said opening of said insulator.

7. A connector as recited in claim 1, in which said center conductor is seized prior to said outer conductor.

8. A connector as recited in claim 1, in which said outer conductor is seized prior to said center conductor.

9. A connector as recited in claim 3, wherein said means for seizing said center conductor includes a hollow conductive member disposed within said opening of said insulator, said means further including at least one spring contact disposed within said hollow conductive member.

10. A connector as recited in claim 1, wherein said coaxial cable is one of a spiral corrugated, corrugated and smooth-walled coaxial cable.

11. A connector as recited in claim 2, wherein said transitional surface section is defined by at least one of a ramped and a curved configuration.

12. A compression connector for a coaxial cable end, said coaxial cable end comprising an exposed center conductor extending from a distal end, an exposed outer conductor extending over an axial portion adjacent said exposed center conductor, and a dielectric layer disposed therebetween, said connector comprising:

a connector body having opposing first and second ends and a center passageway defined therethrough, said center passageway having a first inner diameter and a different second inner diameter linked by a transitional section;

an insulator disposed within said center passageway adjacent said first end of said connector;

a compression sleeve movably connected to the second end of said connector body;

a clamp disposed in relation to said compression sleeve and mounted for axial movement within said center passageway, said clamp having an external surface in contact with the interior surface of said center passageway and an internal surface that is configured for engagement with the outer conductor of an engaged cable end; and a conductive member disposed in an axial opening of said insulator, said conductive member having means for seizing said center conductor, said compression sleeve being axially movable from said second end to said first end to cause said clamp and said conductive member to sequentially engage the outer and center conductors of said cable and in which seizure of said outer conductor occurs either before or after seizure of said center conductor.

13. A connector as recited in claim 12, wherein said means for seizing the center conductor includes a collet portion disposed at one end of said conductive member, said conductive member being a conductive pin, said collet portion being initially disposed externally of said insulator opening.

14. A connector as recited in claim 13, including a drive element disposed between said conductive member and axially movably engageable by said clamp, wherein said drive element acts upon said collet portion to drive said collet section into said insulator opening to cause seizure of said center conductor.

15. A connector as recited in claim 12, wherein said means for seizing the center conductor includes a plurality of spring contacts disposed within an opening of said conductive member.

16. A connector as recited in claim 15, wherein said conductive member is a pin member fixedly disposed within said insulator.

17. A connector as recited in claim 12, wherein said coaxial cable is one of a corrugated, spiral corrugated and smooth-walled coaxial cable.

18. A connector as recited in claim 12, wherein said outer conductor is seized by said clamp before said center conductor is seized.

19. A connector as recited in claim 12, wherein said center conductor is seized before said clamp has seized said outer conductor.

20. A connector for a coaxial cable end, said coaxial cable end comprising an exposed center conductor extending from a distal end, an exposed outer conductor extending over an axial portion adjacent said exposed center conductor and a dielectric layer disposed therebetween, said connector comprising:

a connector body having opposing first and second ends and a center passageway defined therethrough, said center passageway having a first inner diameter and a different second inner diameter linked by a transitional section;

an insulator disposed within said center passageway adjacent said first end of said connector;

a compression sleeve movably connected to the second end of said connector body;

a clamp disposed in relation to said compression sleeve and mounted for axial movement within said center passageway, said clamp having an external surface in contact with the interior surface of said center passageway and an internal surface that is configured for engagement with the center conductor of an engaged cable end; and a conductive member disposed in an axial opening of said insulator, said conductive member having at least one seizing element for seizing said center conductor, said compression sleeve being axially movable from said second end to said first end to cause said clamp and said conductive member to sequentially engage the outer and center conductors of said cable and in which seizure of said outer conductor occurs either before or after seizure of said center conductor.

21. A connector as recited in claim 20, wherein said at least one seizing element includes a flexible collet portion formed at the end of said conductive member, said collet portion being initially disposed externally of said insulator.

22. A connector as recited in claim 21, including a drive element disposed between said conductive member and axially movably engageable by said clamp, wherein said drive element engages and forces said collet section into said insulator opening to cause seizure of said center conductor.

23. A connector as recited in claim 20, wherein said means for seizing the center conductor includes a plurality of spring contacts disposed within an opening of said conductive member.

24. A connector as recited in claim 20, wherein said clamp seizes said outer conductor before said inner conductor is seized.

25. A connector as recited in claim 20, wherein said clamp seizes said outer conductor after said inner conductor has been seized.

26. A connector as recited in claim 20, wherein said coaxial cable is one of corrugated, spiral corrugated and smooth-walled coaxial cable.

* * * * *